US005268041A

United States Patent [19]

Gehmecker et al.

[11] Patent Number: 5,268,041

[45] Date of Patent: Dec. 7, 1993

[54] PROCESS FOR PHOSPHATING METAL SURFACES

[75] Inventors: Horst Gehmecker, Hofheim; Werner Rausch, Oberursel; Peter Schubach, Schöneck-Oberdorfelden, all of Fed. Rep. of Germany

[73] Assignee: Metallgesellschaft AG, Frankfurt am Main, Fed. Rep. of Germany

[21] Appl. No.: 949,349

[22] Filed: Sep. 22, 1992

Related U.S. Application Data

[63] Continuation of Ser. No. 691,129, Apr. 24, 1991.

[30] Foreign Application Priority Data

Apr. 27, 1990 [DE] Fed. Rep. of Germany ..... 4013483

[51] Int. Cl.[5] ..... C23C 22/12

[52] U.S. Cl. ..... 148/260; 148/262; 148/263

[58] Field of Search ..... 148/262, 260, 263

[56] References Cited

U.S. PATENT DOCUMENTS

| | | | |
|---|---|---|---|
| 1,949,090 | 2/1934 | Tanner | 148/262 |
| 2,293,716 | 8/1942 | Darsey | 148/262 |
| 2,302,510 | 11/1942 | Tanner | 148/262 |
| 2,813,812 | 11/1957 | Somers et al. . | |
| 4,338,141 | 7/1982 | Senzaki | 148/262 |
| 4,559,087 | 12/1985 | Jorns | 148/262 |
| 5,039,361 | 8/1991 | Hauffe | 148/262 |

FOREIGN PATENT DOCUMENTS

| | | | |
|---|---|---|---|
| 5492 | 12/1931 | Australia | 148/262 |
| 0060716B1 | 9/1982 | European Pat. Off. . | |
| 526815 | 8/1946 | United Kingdom . | |

*Primary Examiner*—Sam Silverberg
*Attorney, Agent, or Firm*—Herbert Dubno

[57] ABSTRACT

In a process of phosphating metal surfaces phosphating solutions are employed which are substantially free of nickel and contain

| | | | |
|---|---|---|---|
| 0.3 | to | 1.7 | g/l Zn |
| 0.2 | to | 4.0 | g/l Mn |
| 0.001 | to | 0.030 | (preferably 0.003 to 0.020) g/l Cu |
| 5 | to | 30 | g/l phosphate (calculated as $P_2O_5$) |

in which by oxygen and/or other equivalent oxidizers the concentration of Fe(II) is kept below 0.1 g/l and which are adjusted to a pH value from 3.0 to 3.8. The weight ratio of Cu to $P_2O_5$ is preferably adjusted to I: (170 to 30,000) and Cu and $P_2O_5$ are preferably replenished in a weight ratio of 1 : (5 to 2000). The phosphating solutions should contain 0.3 to 1.0 g/1 Zn if they are applied by spraying and should contain 0.9 to 1.7 g/1 Zn if they are applied by spraying/dipping operations or by a dipping operation. The process serves particularly for the pretreatment of metal surfaces for a succeeding painting, particularly by electro-dipcoating, and for the phosphating of steel, galvanized steel, zinc alloy-plated steel, aluminum and its alloys.

16 Claims, No Drawings

PROCESS FOR PHOSPHATING METAL SURFACES

This is a continuation of co-pending application Ser. No. 07/691,129 filed on Apr. 24, 1991.

FIELD OF THE INVENTION

Our present invention relates to a process for phosphating metal surfaces by a treatment with aqueous acid phosphating solutions which contain zinc ions, manganese ions, phosphate ions, and oxidizers. The invention also relates to the use of the process for pretreating the metal surfaces for a succeeding painting (especially a lacquer coating), particularly by electro-dip lacquering, and to the phosphating of steel, aluminum and its alloys.

BACKGROUND OF THE INVENTION

Metals are phosphated to form metal phosphate layers which are firmly intergrown with the metal surface and which in themselves improve the resistance to corrosion and in combination with paints and other organic coating will contribute to a substantial increase of the adhesion and of the resistance to subsurface corrosion. Phosphate layers also serve as insulation against passage of electric currents and, in combination with lubricants, will reduce sliding friction.

A pretreatment before a painting operation may particularly be effected by a low-zinc phosphating process, in which phosphating solutions are employed which have relatively low contents of zinc ions amounting to 0.5 to 1.5 g/l. The phosphate layers formed on steel under such conditions will have a high content of phosphophyllite ($Zn_2Fe(PO_4)_2.4H_2O$), which has a much higher resistance to corrosion than the hopeite ($Zn_3(PO_4)_2.4H_2O$) deposited from relatively high-zinc phosphating solutions. If the low-zinc phosphating solutions contain also nickel ions and/or manganese ions, the protection afforded in the presence of paints will be increased further.

Low-zinc processes in which 0.5 to 1.5 g/l manganese ions and 0.3 to 2.0 g/l nickel ions are employed are widely used as so-called three-cation processes to prepare metal surfaces for a painting operation, e.g. before a cathodic electro-dip lacquer coating of automobile car bodies.

These processes are disadvantageous due to the high content of nickel ions in the phosphating solutions used in the three-cation processes and to the high content of nickel and of nickel compounds in the resulting phosphate layers, because nickel and nickel compounds are undesirable from the aspects of workplace hygiene and pollution of the environment.

OBJECT OF THE INVENTION

It is an object of the invention to provide an improved process for the phosphating of metals, particularly of steel, galvanized steel, zinc alloy-plated steel and aluminum and its alloys, by which phosphate layers can be formed which have approximately the same quality as the layers produced by the three-cation processes using Zn-Mn-Ni but are free from nickel and from nickel compounds.

DESCRIPTION OF THE INVENTION

To achieve this object the phosphating process of the kind described first hereinbefore is carried out in accordance with the invention in such a manner that the metal surfaces are contacted with phosphating solutions which are substantially free of nickel and contain

| | | | |
|---|---|---|---|
| 0.3 | to | 1.7 | g/l Zn |
| 0.2 | to | 4.0 | g/l Mn |
| 0.001 | to | 0.030 | g/l Cu |
| 5 | to | 30 | g/l phosphate (calculated as $P_2O_5$) |

in which by oxygen and/or other equivalent oxidizers the concentration of Fe (II) is kept below 0.1 g/l and which are adjusted to a pH value from 3.0 to 3.8.

More particularly, the process of the invention comprises the steps of:

forming an aqueous acid phosphating solution substantially free from nickel and which contains zinc ions, manganese ions, phosphate ions, and an oxidizer and comprising

| | | | |
|---|---|---|---|
| 0.3 | to | 1.7 | g/l Zn |
| 0.2 | to | 4.0 | g/l Mn |
| 0.001 | to | 0.030 | g/l Cu |
| 5 | to | 30 | g/l phosphate calculated as $P_2O_5$ |

contacting the metal surface with this solution for a duration and at a temperature sufficient to bond a durable phosphate coating to said surface; and maintaining during contact with the surface a concentration of Fe(II) in said solution below 0.1 g/l with the oxidizer and adjusting said solution to a pH value from 3.0 to 3.8.

The process in accordance with the invention is particularly used to treat steel, galvanized steel, zinc alloy-plated steel, aluminum and its alloys. The term "steel" covers soft plain (nonalloyed) carbon steels, relatively high-strength alloyed steels and high-strength steels (which may be, e.g. microalloyed, or dual-phase or phosphorus-alloyed steels), and low-alloy steels. The zinc layers may be formed by electrolysis, hot dipping and vapor deposition.

Typical zincs which can be used include pure zinc and alloys containing Fe, Ni, Co, Al and Cr. The term aluminum and aluminum alloys covers the cast and wrought material which are used in the metal-working industry and which may contain, e.g. Mg, Mn, Cu, Si, Zn, Fe, Cr, Ni, Ti as alloying elements.

It is a basic requirement for the process in accordance with the invention that the aqueous acid phosphating solutions must be substantially free of nickel. This means that under technical conditions the Ni concentration in the phosphating baths must be lower than 0.0002 to 0.01 g/l and preferably below 0.0001 g/l.

Another essential feature of the invention is the presence of the three metal cations Zn, Mn and Cu in the stated amounts. Particularly in the treatment of steel, a zinc concentration below 0.3 g/l will result in the formation of a layer of poor quality. If the zinc content exceeds 1.7 g/l, the phosphate layers formed on steel will have a much lower phosphophyllite content and the resulting phosphate layers will have a poor quality in combination with a paint. With a content below 0.2 g/l Mn the addition of said cations will not result in detectable advantages and a further improvement of the detected quality cannot be expected with concentrations in excess of 4 g/l. The Cu concentration is between 0.001 and 0.030 g/l. Below that range the favorable effect on the formation of the layer and on the quality of the layer will be lost, and a copper content above 0.030 g/l will increasingly result in a disturbing cementation of Cu.

In the phosphating of steel, Fe will be dissolved as Fe(II) ions. The phosphating bath must contain sufficient oxygen and/or other oxidizers to prevent a steady-state Fe(II) ion concentration in excess of 0.1 g/l. That is to say that any Fe(II) which might tend to be formed over 0.1 g/l must be transformed to Fe(III) and precipitated as iron phosphate sludge.

To ensure the formation of a satisfactory phosphate layer the phosphating solution must be adjusted to a pH value between 3.0 and 3.8. The higher pH values are employed at lower bath temperatures and at lower bath concentration conversely the lower pH values apply at higher bath temperatures and concentrations. In case of need the pH value of the bath may be adjusted by a co-use of additional cations, such as alkali ions (Na, K, $NH_4$, etc.), and/or alkaline earth metal ions (Mg, Ca) and/or additional anions ($NO_3$, Cl, $SiF_6$, $SO_4$, $BF_4$, etc.). The pH value of the phosphating solution may be corrected during the preparation and use of the solution by an addition of basic compounds (NaOH, $Na_2CO_3$, ZnO, $ZnCO_3$, $MnCO_3$, etc.) or of acids ($NHO_3$, $H_3PO_4$), $H_2SiF_6$, HCl, etc.) as may be required.

The quality of the phosphate layers formed by the process in accordance with the invention may be improved by the addition of up to 3 g/l Mg and/or up to 3 g/l Ca. The concentration of each of these cations lies preferably in the range from 0.4 to 1.3 g/l. The cations may be introduced into the phosphating solution as a phosphate or as a salt including the above-mentioned anions. The oxides, hydroxides and carbonates may also be used as sources of Mg and Ca.

If the process in accordance with the invention is carried out by a spraying operation, the Zn concentration will preferably lie between 0.3 and 1 g/l whereas for a spraying-dipping operation and for a dipping operation the bath is preferably adjusted to a Zn content between 0.9 and 1.7 g/l. The preferred Mn concentration is between 0.4 and 1.3 g/1, regardless of the mode of application.

According to a preferred feature of the invention, the metal surfaces are contacted with a phosphating solution which contains 0.003 to 0.020 g/l Cu. Particularly good results will be produced if a phosphating bath is used in which the weight ratio of Cu to phosphate, calculated as $P_2O_5$, is 1:(170 to 30,000), and Cu and $P_2O_5$ are replenished in a weight ratio of 1: (5 to 2000).

To limit the Fe(II) concentration the phosphating solution is contacted with oxygen, such as atmospheric oxygen, and/or suitable oxidizers are added. Preferred oxidizers include nitrite, chlorate, bromate, peroxy compounds ($H_2O_2$, perborate, percarbonate, perphosphate, etc.), and organic nitro compounds, such as nitrobenzene sulfonates. Such oxidizers may be used alone or in combination, optionally also with weaker oxidizers such as nitrate. Suitable combinations are, e.g., nitrite-nitrate, nitrite-chlorate(-nitrate), peroxy compound-$NO_3$, bromate-nitrate, chlorate-nitrobenzene sulfonate(-nitrate), bromate-nitrobenzene sulfonate(-nitrate). The oxidizers serve not only to oxidize Fe(II) ions but will also accelerate the formation of the phosphate layer.

Examples of typical concentration ranges of said oxidizers in the phosphating bath are 0.04 to 0.5 g/l nitrite; 0.5 to 5 g/l chlorate; 0.3 to 4 g/l bromate; 0.005 to 01 g/l peroxy compound, calculated as $H_2O_2$; 0.05 to 1 g/l nitrobenzene sulfonate.

In accordance with a further preferred feature of the invention the metal surfaces are contacted with phosphating solutions which additionally contain modifying compounds of the group consisting of surfactants, hydroxycarboxylic acid, tartrate, citrate, simple fluoride, borofluoride, silico-fluoride. The addition of a surfactant (e.g. 0.05 to 0.5 g/l) will improve the phosphating of slightly greasy metal surfaces. Hydroxycarboxylic acids, such as tartaric acid citric acid and/or their salts, in concentrations in the range from 0.03 to 0.3 g/l, will distinctly decrease the weight of the phosphate layer. A simple fluoride (e.g. $NaF_2$) will promote the phosphating of metals which can be attacked only with difficulty and will reduce the minimum phosphating time and increase the surface area covered by the phosphate layer. This may be accomplished by F contents of 0.1 to 1 g/l. Besides, the controlled addition of simple fluoride will permit a formation of crystalline phosphate layers on aluminum and its alloys. $BF_4$ and $SiF_6$ will also increase the aggressiveness of the phosphating baths and this will become distinctly apparent in the treatment of hot-galvanized surfaces. Such additions are made, e.g., in amounts of 0.4 to 3 g/l.

The phosphating process in accordance with the invention can be carried out by spraying, spraying-dipping and dipping operations. The bath temperatures lie usually between 40° and 60° C.

For a treatment of steel and aluminum, contacting times of, e.g., 1 to 5 minutes will be sufficient for a deposition of uniformly covering phosphate layers. On the other hand, contacting times shorter than 10 seconds are often sufficient in the treatment of galvanized steel so that the process can also be carried out in coil coating plants or like continuous treatment facilities.

Before being contacted with the phosphating solution, the surfaces are usually cleaned and rinsed and are often treated with activators based on titanium phosphate.

The phosphate layers formed by the phosphating process in accordance with the invention are finely crystalline and effect a uniform coverage. The weight per unit of area is usually between 1.5 to 4.5 g/m$^2$ in the treatment of steel, galvanized steel and zinc alloy-plated steel and between 0.5 and 2.5 g/m$^2$ in the treatment of aluminum and its alloys.

During the phosphating treatment, components of the phosphating solution are consumed, e.g. by incorporation in the phosphate layer, sludge formation, mechanical losses of bath solution remaining on the treated metal surfaces or in the sludge to be carried off, or by oxidation-reduction reactions and also decomposition. For that reason the analysis of the phosphating solution must be monitored and the deficient components must be replenished.

The phosphate layers may be used to advantage, inter alia, for protection against corrosion, to facilitate cold working and for electrical insulation. They are preferably used to prepare metal surfaces for a painting operation in which a surface may be coated with a lacquer, particularly by electro-dipcoating, and particularly good results will be produced in a combination with a cathodic electro-dipcoating. Before the painting operation the phosphate layers are preferably treated with passivating postrinsing agents based, e.g., on Cr(VI), Cr(VI)- Cr(III), Cr(III), Cr(III)-fluozirconate, Al(III), AI(III)-fluozirconate, because this will further improve the adhesion of the paint and its resistance to migration under the paint. After rinsing, the phosphate coating can be dried.

SPECIFIC EXAMPLES

The invention will be explained in greater detail with reference to the following examples Sheets of steel, galvanized steel, and aluminum were degreased with an alkaline cleaning agent and rinsed with water and after an optional activating pretreatment with a solution which contained titanium phosphate were phosphated by a treatment with phosphating solutions 1 to 12 at 50° C. In all cases, uniformly covering phosphate layers were formed, which in combination with a paint applied by cathodic electro-dip-coating and further painting (automobile-type lacquer coating) provided a high resistance to corrosion and migration under the paint.

| | 1 | 2 | 3 | 4 | 5 | 6 | 7 | 8 | 9 | 10 | 11 | 12 |
|---|---|---|---|---|---|---|---|---|---|---|---|---|
| Zn (g/l) | 0.7 | 0.7 | 0.9 | 0.8 | 0.8 | 0.7 | 0.7 | 1.3 | 1.5 | 1.3 | 1.3 | 1.4 |
| Mn (g/l) | 1 | 0.8 | 1 | 1 | 1 | 1 | 1 | 1.5 | 0.7 | 1 | 1 | 1.2 |
| Mg (g/l) | — | 0.8 | — | 1 | — | — | — | — | 1.2 | — | — | 0.8 |
| Cu mg/l | 5 | 3 | 5 | 3 | 5 | 4 | 4 | 5 | 4 | 3 | 4 | 5 |
| Na (g/l) | 3.47 | 2.13 | 4.68 | 2.86 | 3.67 | 5.82 | 3.69 | 3.92 | 1.80 | 4.39 | 4.78 | 5.4 |
| Ca (g/l) | — | 1.3 | — | — | — | — | — | — | — | — | — | — |
| $P_2O_5$ (g/l) | 12 | 12 | 14 | 14 | 13 | 13 | 6 | 10 | 10 | 11 | 16 | 18 |
| $NO_2$ (g/l) | 0.07 | 0.07 | 0.09 | 0.09 | — | 0.17 | 0.17 | 0.17 | 0.15 | 0.11 | — | — |
| $ClO_3$ (g/l) | — | — | — | — | — | — | — | — | — | — | 2 | 3 |
| NBS (g/l) | — | — | — | — | — | — | — | — | — | — | 0.6 | 0.5 |
| $H_2O_2$ (g/l) | — | — | — | — | 0.03 | — | — | — | — | — | — | — |
| $NO_3$ (g/l) | 3 | 3 | 4 | 4 | 3 | 7 | 7 | 8 | 7 | 6 | 3 | — |
| Cl (g/l) | — | — | — | — | — | — | — | — | — | — | — | 4 |
| F (g/l) | — | — | 0.3 | 0.3 | — | 0.1 | 0.1 | — | — | 0.1 | — | — |
| $SIF_6$ (g/l) | — | — | — | — | — | 1.2 | 1.2 | — | — | 1.2 | — | — |
| pH | 3.4 | 3.4 | 3.4 | 3.4 | 3.4 | 3.4 | 3.6 | 3.3 | 3.3 | 3.3 | 3.3 | 3.3 |
| TA | 20.1 | 20.3 | 23.4 | 23.7 | 21.8 | 25.0 | 14.6 | 18.6 | 18.3 | 22.8 | 26.9 | 30.6 |
| Application | S | S | S | S | S | S | S | D | D | D | D | D |
| LW ($g/m^2$) on steel | 2.7 | 2.3 | 2.5 | 2.3 | 1.8 | 2.5 | 2.3 | 3.2 | 3.0 | 3.3 | 2.1 | 2.0 |
| LW ($g/m^2$) on galvanized steel | 2.8 | 2.5 | 2.3 | 2.4 | 1.9 | 2.8 | 2.7 | 3.4 | 3.2 | 3.5 | 2.0 | 2.0 |
| LW ($g/m^2$) on aluminum | — | — | 2.2 | 2.0 | — | 0.8 | 0.7 | — | — | 0.6 | — | — |

EXPLANATIONS
NBS = nitrobenzene sulfonate sodium salt
TA = total acid = consumption of 0.1 N NaOH in ml for 10 ml bath sample against phenolphthalein
LW = weight of layer
S = spraying
D = dipping
The Fe(II) concentration is less than 0.1 g/l in all baths.

We claim:

1. A process for phosphating a metal surface, comprising steps of:

forming an aqueous acid phosphating solution substnatially free from nickel and which contains zinc ions, manganese ions, phosphate ions, and an oxidizer and comprising

| | | | |
|---|---|---|---|
| 0.3 | to | 1.7 | g/l Zn |
| 0.2 | to | 4.0 | g/l Mn |
| 0.003 | to | 0.020 | g/l Cu |
| 5 | to | 30 | g/l phosphate calculated as $P_2O_5$ and in which the weight ratio of Cu to $P_2O_5$ is 1:170 to 1:30,000; |

contacting the metal surface with said solution for a uration and at a temperature sufficient to bond a durable phosphate coating to said surface; and maintaining during contact with said surface of concentration of Fe(II) in said solution below 0.1 g/l with said oxidizer and adjusting said solution to a pH value from 3.0 to 3.8.

2. The process defined in claim 1 wherein said oxidizer includes oxygen.

3. The process defined in claim 1 wherein the metal surface is contacted with said phosphating solution which additionally contain Mg and/or Ca in amounts of up to 3.0 g/l each.

4. The process defined in claim 3 wherein said Mg or Ca are present in said solution in amounts of 0.4 to 1.3 g/l each.

5. The process defined in claim 1 wherein the metal surface is sprayed with said phosphating solution and said phosphating solution is adjusted to contain 0 3 to 1.0 g/l Zn.

6. The process defined in claim 1 wherein said metal surface is dipped into said phosphating solution and said solution is adjusted to contain 0.9 to 1.7 g/l Zn.

7. The process defined in claim 1, further comprising adjusting the composition of the phosphating solution to contain 0.4 to 1.3 g/l Mn.

8. The use of the process according to claim 1 for phosphating steel, galvanized steel, zinc alloy-plated steel, aluminum and its alloys.

9. The process defined in claim 1, further comprising the step of replenishing Cu and $P_2O_5$ in said solution in a weight ratio of 1:5 to 1:2000.

10. The process defined in claim 1 wherein said oxidizer includes nitrite, chlorate, bromate, peroxy compounds or organic nitro compounds.

11. The process defined in claim 10 wherein said oxidizer includes a nitrobenzene sulfonate.

12. The process defined in claim 1, further comprising the step of introducing into said solution at least one modifying compound selected from the group consisting of surfactants, hydroxycarboxylic acids, tartrates, citrates, simple fluorides, borofluorides and silicofluorides.

13. The process defined in claim 1 wherein said metal surface is a steel, galvanized steel, zinc-alloy-plated steel, aluminum or aluminum alloy surface, said solution contains at least one of Mg and Ca in an amount of 0.4 to 1.3 g/l and the manganese is present in said solution in an amount of 0.4 to 1.3 g/l.

14. The process defined in claim 13, further comprising the steps of rinsing and drying said durable phosphate coating and thereafter lacquer-coating same.

15. The process defined in claim 14 wherein the lacquer coating is effected by electro-dipcoating.

16. The use of the process according to claim 1 for pretreating a metal surface for a succeeding painting.

* * * * *